United States Patent [19]

Jundt et al.

[11] 4,105,006

[45] Aug. 8, 1978

[54] IGNITION SYSTEM FOR INTERNAL COMBUSTION ENGINE

[75] Inventors: Werner Jundt, Ludwigsburg; Peter Werner, Stuttgart; Bernd Bodig, Leinfelden; Gerhard Söhner, Remshalden-Geradstetten; Helmut Roth, Stuttgart, all of Fed. Rep. of Germany

[73] Assignee: Robert Bosch GmbH, Stuttgart, Fed. Rep. of Germany

[21] Appl. No.: 703,780

[22] Filed: Jul. 9, 1976

[30] Foreign Application Priority Data

Jul. 12, 1975 [DE] Fed. Rep. of Germany ..... 2531278

[51] Int. Cl.[2] ..... F02P 3/02

[52] U.S. Cl. ..... 123/148 E

[58] Field of Search ..... 123/148 E, 148 CB, 146 SD; 315/209 T, 209 SC, 219

[56] References Cited

U.S. PATENT DOCUMENTS 3,575,154 4/1971 Taylor ..... 123/148 E

*Primary Examiner*—Samuel Feinberg

*Attorney, Agent, or Firm*—Flynn & Frishauf

[57] ABSTRACT

Current flow to the ignition coil during low-speed operation of the engine, is controlled by an auxiliary control switch which is connected in shunt with the primary of the ignition coil. Serially connected with the primary is a main control switch which is controlled to close until current through the primary has reached a certain value, at which time the main switch opens and the shunt auxiliary switch is closed to permit continued inductive current flow through the coil and thus store ignition energy, the cycle repeating to maintain current flow through the primary at a level to store sufficient energy for the ignition spark which, at the ignition instant, effects opening of the shunt circuit by opening the auxiliary switch while also opening the circuit to the primary, thus providing a high-voltage pulse which provides for sparking of the spark plug. The sensor for current flow through the primary is preferably a resistor which, when the voltage drop thereacross exceeds a predetermined level, controls changeover of a transistor.

13 Claims, 1 Drawing Figure

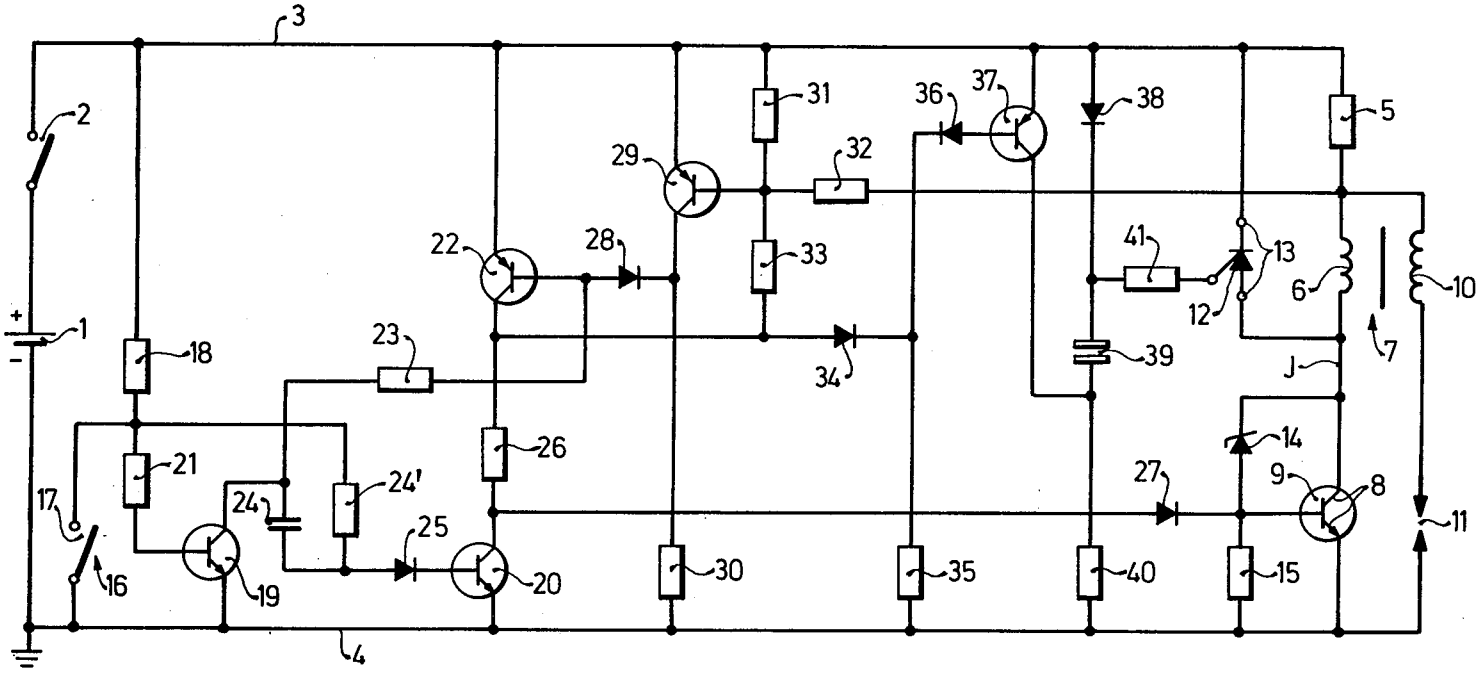
1
2
3
4
5
6
7
8
9
10
11
12
13
14
15
16
17
18
19
20
21
22
23
24
24'
25
26
27
28
29
30
31
32
33
34
35
36
37
38
39
40
41
J
+
-

IGNITION SYSTEM FOR INTERNAL COMBUSTION ENGINE

CROSS REFERENCE TO RELATED APPLICATION

U.S. Ser. No. 704,116, filed July 9, 1976 (claiming priority of German Application P 2,531,337.5 of July 12, 1975 —inventors: Bernd BODIG et al.), and assigned to the assignee of the present application.

The present invention relates to an ignition system for remotely ignited internal combustion engines, and more particularly to a system having an ignition coil which stores sparking energy for the spark plugs and which has its primary connected through a controlled switch to a source of current supply.

Ignition systems using ignition coils, in which sparking energy is stored in the inductive field of the coil, are preferred for many applications in internal combustion engines since the system is simple and reliable. The wide speed ranges of internal combustion engines, and particularly automotive internal combustion engines, cause difficulty with current supply to the ignition coil, however. Ignition coils connected to the on-board electrical system of an automotive vehicle receive, when the engine is operating at low speed, current through the primary winding for much longer periods of time than necessary to store energy to obtain effective spark at the spark plug. This loads the electrical system and causes unnecessary use of energy.

It is an object of the present invention to provide an ignition system in which the current used to store energy to effect sparking of the spark plug, even at low engine speeds, is not excessive.

SUBJECT MATTER OF THE PRESENT INVENTION

Briefly, the shunt circuit is connected to the primary winding of the ignition coil which includes an auxiliary switch. The main switch, serially connected to the ignition coil, and preferably a switching transistor, is controlled to be conductive in accordance with sensed current flow through the coil, for example by sensing the voltage drop across a resistor, and to interrupt current flow therethrough when the current has reached a predetermined level, at which time the auxiliary switch is energized to permit continued current to flow through the coil due to the inductive storage effect thereof. When the current in the coil has dropped to a predetermined level, the main switch is again energized; this cycle repeats until the ignition instant occurs, at which time, if the main switch should be closed, it opens while, simultaneously, the shunting auxiliary switch is likewise controlled to remain open.

The invention will be described by way of example with reference to the accompanying drawings, wherein the single FIGURE is a schematic circuit diagram of the system in accordance with the present invention.

An internal combustion engine—not shown—and preferably an automotive vehicle internal combustion engine, provides power to a battery 1, for example the battery of an automotive vehicle. The positive terminal of the battery is connected through an ignition switch 2 to the main positive bus 3. The negative terminal of the battery is connected to ground or chassis to form a chassis connection 4. Positive bus 3 is connected to a sensing resistor 5 and hence to the primary winding 6 of an ignition coil 7. A control switch 8 is serially connected between the ignition coil 7 and chassis bus 4. The control switch 8, in the example, is formed by the emitter-collector path of an npn switching transistor 9 having its emitter connected to the chassis bus 4. The switching transistor 9 may, for example, be a Darlington circuit combination, or another controlled type of switch, preferably a semiconductor switch.

Secondary winding 10 of ignition coil 7 is connected to a spark plug 11. If the engine is a multi-cylinder engine, a distributor can be interposed between the secondary 10 and the spark plug 11, as well known.

The terminal of the primary winding 6 which is connected to the switch 8 forms a junction J from which an auxiliary shunt circuit extends formed by a thyristor 12. The anode-cathode path of the thyristor 12 forms an auxiliary switch 13 which, when ignition energy is stored in coil 7, is controlled for alternate energization with main switch 8 in such a manner that, when switch 8 is connected or conductive, switch 13 is open, and vice versa. The control of the change of state of the switches depends on current value flowing in the primary winding 6, as will appear in detail below.

The collector of switching transistor 9 is connected to the cathode of a Zener diode 14, the anode of which is connected over resistor 15 with negative bus 4. The junction of Zener diode 14 and resistor 15 is connected to the base of switching transistor 9. This arrangement is provided to protect the emitter-collector path of switching transistor 9 against over-voltages.

Ignition energy is stored in the ignition coil under control of a control switch 16 which may, for example, form the breaker contact of a distributor breaker arrangement shown schematically only by reference numeral 17. Control switch 16 may take other forms, for example the emitter-collector path of a transistor which is switched by means of the breaker 17 making and breaking contacts, or without mechanical contacts, for example by a signal source providing output signals in synchronism with rotation of the engine to control the instantaneous timing of the ignition spark, i.e. the ignition instant. Such a transistor can, in turn, be controlled by means of one or more flip-flop circuits or the like. Breaker-less ignition control systems are known and, in one embodiment, operate similarly to a-c generators by providing output signals to control such a transistor of a system 17.

The switch 16 has one terminal connected to negative bus 4; the other terminal is connected through resistor 18 with positive bus 3. The switch 16 is connected to a monostable multivibrator formed of two npn transistors 19, 20. The first transistor 19 has its emitter connected to the negative bus 4, and its base through a resistor 21 to the non-grounded terminal of switch 16. The collector of the first transistor 19 is connected to a coupling transistor 22 through a coupling resistor 23; it is further connected through a capacitor 24 with the anode of a diode 25, the cathode of which is connected to the base of the second transistor 20 and, when energized, raises the voltage at the base above the conduction threshold of transistor 20. The anode of diode 25 is further connected over a resistor 24' with the junction between resistors 18 and 21 which also forms the ungrounded terminal of switch 16. The second transistor 20 has its collector connected to a resistor 26 which, in turn, is connected to the collector of coupling transistor 22. The emitter is connected to chassis bus 4. The collector of transistor 20 is further connected through a blocking diode 27 to the junction between Zener diode 14 and resistor 15 and hence to the base of transistor 9. The base of the coupling transistor 22 is connected to the anode of a blocking diode 28, the cathode of which is connected to the collector of the second coupling transistor 29 as well as through a resistor 30 to chassis bus 4. The base of the second coupling transistor 29 is connected to a junction from which three resistors branch off: resistor 31 is connected to positive bus 3; resistor 33, acting as a positive feedback resistor, is connected back to the collector of coupling transistor 22. The third resistor 32 is connected to the terminal of the primary winding 6 of ignition coil 7 opposite that of junction J and hence also to the terminal of the sensing resistor 5 which is not connected to positive bus 3. The emitter of transistor 29 is connected to positive bus 3.

The terminal of resistor 33 which is not connected to the base of transistor 29 is additionally connected to the anode of a blocking diode 34, the cathode of which is connected to a junction which connects through a resistor 35 to chassis bus 4 on the one hand, and to the cathode of a further diode 36, on the other. The anode of the diode 36 is connected to the base of a pnp control transistor 37 and, when energized, raises the voltage level thereof to cause transistor 37 to become conductive.

A diode 38, poled to be normally conductive, is connected to positive bus 3, the cathode of which is connected to a control capacitor 39 and through a resistor 40 to negative bus 4. The cathode of diode 38 is further connected through a resistor 41 to the gate electrode of thyristor 12. Resistor 41 is a calibrating resistor. The junction between capacitor 39 and resistor 40 is connected to the collector of transistor 37. The emitter of transistor 37 is connected to positive bus 3.

Operation: The ignition system is ready for operation as soon as switch 2 is closed. Let it be assumed that, upon rotation of the engine, switch 16 is closed. The base-emitter path of the first transistor 19 and of the second transistor 20 thus no longer receive control current, due to short-circuiting of resistors 21 and 24', causing the emitter-collector paths of the transistors 19, 20 to open, since the transistors will block. The second coupling transistor 29 has its emitter-collector path likewise blocked, so that the emitter-base path of the first coupling transistor 22 can have current flow thereover, which will continue over blocking diode 28 and resistor 30 to negative bus 4. The emitter-collector path of the first coupling transistor 22, resistor 26, blocking diode 27 and the base-emitter path of the switching transistor 9 thus will have current flow therethrough, causing switch-over of transistor 9 into conductive state.

As soon as transistor 9 becomes conductive, current will begin to flow from battery 1 through bus 3, sensing resistor 5 and primary winding 6. This current will rise exponentially due to the inductance of coil 6 until it reaches a predetermined value at which time sufficient ignition energy has been stored in coil 7 to effect a spark 11 upon interruption of the current flow. The sensing resistor 5 is so dimensioned that the voltage drop thereacross, at that current flow, will cause the emitter-collector path of the second coupling transistor 29 to become conductive, by feedback of the voltage through resistor 32. When the second coupling transistor 29 becomes conductive, first coupling transistor 22 will be blocked, which blocking action is accelerated by the presence of the feedback resistor 33. No more control current will be provided for the transistor 9 forming the main switch 8, so that it will open, that is, transistor 9 will block. The inductive voltage of the primary winding 6 is now effective at the collector of the transistor 9 as well as on the anode of thyristor 12. The emitter-collector path of the first coupling transistor 22 is, however, still blocked, so that current can flow over the emitter-base path of the transistor 37, diode 36 and resistor 35, which will cause the transistor 37 to be conductive. The control capacitor 39, previously charged through diode 38 and resistor 40, can now discharge over resistor 41 and the control path of thyristor 12, as well as through the emitter-collector path of the control transistor 37. The anode-cathode path of the thyristor thus will become conductive which, in effect, means that the auxiliary switch 13 will close. The induced voltage can no longer rise, and current, depending on this voltage, will now flow over the auxiliary switch 13 as well as continue to flow through the sensing resistor 5. This current will decrease gradually due to losses in the circuit until it reaches a value which has been predetermined, and still leaves sufficient current flow to provide ignition energy for a spark in the spark plug. When the current reaches this value which approaches the minimum energy necessary to effect sparking of the spark plug, the voltage drop across resistor 5 will be insufficient to maintain the second coupling transistor 29 conductive, so that the emitter-collector path of the second coupling transistor 29 will again block and, as a result, the first coupling transistor 22 will become conductive. When the first coupling transistor 22 has become conductive, and main switch 8 continues closed current will again to flow through the primary winding 6 supplied from the battery 1. Thyristor 12 will no longer have positive voltage applied at the anode, and will block. Current will again rise in primary winding 6 until the voltage drop across sensing resistor 5 causes transistor 29 to become conductive, and the cycle will repeat. This cycle will repeat for as long as the switch 16 is closed, that is, during the closed dwell period of that switch 16.

At the ignition instant, switch 16 opens, that is, current flow therethrough is interrupted. Initially, the emitter-collector path of the first transistor 19, and in dependence thereon, the emitter-collector path of coupling transistor 22 will become conductive. Since the capacitor 24 will requre some time to change charge state, the emitter-collector path of the second transistor 20 will remain non-conductive for a short additional time interval; a suitable time interval is, approximately, 50 $\mu$ seconds. This timing period, controlled by the transistors 19, 20, ensures that the main switch will remain current-carrying, that is, closed, for a short period of time so that the anode-cathode path of thyristor 12—if it should, at that instant, be conductive, is reliably blocked, and brought into open-circuit state. Since the emitter-collector path of the first coupling transistor 22 is conductive, the emitter-collector path of transistor 37 will be blocked, so that the thyristor 12 cannot be controlled to conduction. When capacitor 24 has changed charge state, the emitter-collector path of the second transistor 20 of the monostable multivibrator formed by transistors 19, 20 will likewise become conductive, so that the emitter-collector path of the main switch 8 will open. Current flow through the primary 6 of ignition coil 7 is now suddenly interrupted, and since the shunt circuit formed by switch 13 is likewise open, the secondary 10 will have a high-voltage pulse induced therein which causes a spark at spark plug 11.

Ignition energy is stored in primary winding 6 in short periodically sequential pulses, occurring in sequential time periods, during which current will flow from current source 1. The overall current requirement is substantially decreased.

Various changes and modifications may be made within the scope of the inventive concept.

We claim:

1. Ignition system for an internal combustion engine adapted for connection to a current supply source (1) having an ignition coil (7), a main switch (8) serially connected with the ignition coil (7) to control current flow therethrough;

a sensing resistor (5) serially connected with the primary of the coil (7) sensing current flow through the primary (6) of the ignition coil (7) and providing a respective sensing signal;

a shunt circuit comprising an auxiliary controlled switch (13) connected in shunt with the primary (6) of the ignition coil (7) and the sensing resistor (5), control circuit means (29, 22) connected to said sensing resistor (5), responsive to said sensing signal, sensing a predetermined current flow through the coil (7) and controlling the respective switching states of the main switch (8) and of the auxiliary switch (13) to be alternatively conductive to store ignition energy in the coil during conduction of the main switch (8) and non-conduction of the auxiliary controlled switch (13) and to disconnect the primary of the coil from the power source (1) during opening of the main switch and establishment of a closed series circuit formed by said then closed auxiliary controlled switch (13), the sensing resistor (5) and the primary (6) of the ignition coil;

and an interrupt control switch (16) connected to and controlling opening of said main switch to control the timing of the ignition instant independently of sensed current flow through said sensing resistor (5).

2. System according to claim 1, wherein the auxiliary switch (13) comprises the anode-cathode path of a thyristor (12).

3. System according to claim 1, wherein the main switch (8) comprises the emitter-collector path of a switching transistor (9).

4. System according to claim 1, wherein the sensing means resistor (5) is connected in a series circuit: one terminal (3) of the current supply source (1), the sensing resistor (5), the primary winding (6) of the ignition coil (7), the main switch (8) and the return to the other terminal (4) of the supply source (1).

5. System according to claim 4, wherein said series circuit comprises only said circuit formed by the sensing resistor (5), the primary (6) of the ignition coil (7) and the main switch (8).

6. System according to claim 4, wherein the auxiliary switch comprises a thyristor having one terminal of the anode-cathode path connected to the junction between the primary winding (6) of the ignition coil and the main switch (8), the other terminal being connected to one terminal of the power supply.

7. System according to claim 6, further comprising a control circuit for the thyristor (12) including:

a diode (38) connected to one terminal (3) of the source (1) and poled in conductive direction, and a capacitor (39) in series with said diode, said capacitor being connected to the other terminal of the source;

a charge control resistor (4) included in the series circuit formed by the diode (38) and the capacitor (39);

and a connection from the circuit between the diode (38) and the capacitor (39) connected to the gate electrode of the thyristor (12);

and a transistor (37) having its emitter-collector path connected in parallel to the diode and the capacitor (39), the other terminal of said emitter-collector path of the transistor (37) being connected to one terminal of the power supply.

8. System according to claim 4, wherein the control circuit means comprises a coupling transistor (29) having its base and one other electrode connected across said sensing resistor (5) so that, when the current through the resistor rises to a predetermined value, the voltage drop across said resistor (5) will control said transistor (29) to change conduction state;

and a connection network (33, 34, 36, 35, 37, 38, 39, 41; 28, 22, 26, 27) connected to both said main switch (8) and said auxiliary switch (13) and alternatingly controlling said switches in dependence on the conduction state of said coupling transistor (29).

9. System according to claim 8, further comprising a timing circuit (19, 24, 20) connected to said auxiliary switch (13) and said main switch (8) and controlling said main switch (8) to be conductive for the duration of the timing interval of said timing circuit, and then open, while simultaneously controlling the auxiliary switch (13) to also open to abruptly interrupt current flow through the primary (6) of the ignition coil (7) and thus induce a high-voltage spark pulse in the secondary (10) of the ignition coil, connection of the main switch (8) during said timing interval ensuring turn-off and opening of the auxiliary switch (13) prior to interruption of current flow through the primary (6) of the coil (7) and preventing inductive current flow through said shunt circuit.

10. System according to claim 9, wherein the auxiliary switch (13) comprises a thyristor (12), a control circuit is connected to the gate electrode of said thyristor and comprises a control transistor (37), a charging diode (38), a charging capacitor (39) and a charging resistor (40) being serially connected across the source of supply, the junction between the diode (38) and the capacitor (39) being connected to the gate electrode and the junction between the capacitor (39) and the resistor (40) being connected to the emitter-collector path of the transistor (37) so that the transistor, when conductive, will shunt the diode and the capacitor and permit discharge of the capacitor through the conductive transistor as well as controlling the gate of the gate electrode of the thyristor (13) to render the thyristor conductive;

and wherein the connection network comprises an additional coupling transistor (22) having its base connected through a diode (28) to the collector of said coupling transistor (29), the thyristor controlled transistor having its base connected through a further diode (34) to the collector of said further coupling transistor (22);

a positive feedback resistor (33) connected between the base of the coupling transistor (29) and the collector of said further coupling transistor (22);

the base-emitter path of the coupling transistor being connected across a sensing resistor (5).

11. System according to claim 10, wherein the timing circuit comprises two transistors (19, 20) and a capacitor (24) connected from the collector of one transistor to the base of the other (20), conduction of the first transistor (19) being controlled by the interrupt control means (16);

the collector of the first timing circuit transistor (19) being connected to the base of the further coupling transistor (22) to control conduction thereof upon closing of said interrupt control means, the other timing circuit transistor (20) controlling change in conduction of said further transistor upon opening of said interrupt control means so that conduction of said further coupling transistor is controlled by both said interrupt control means and the timing period of the timing circuit.

12. System according to claim 11, wherein the first timing circuit transistor (19) and the second timing circuit transistor (20) are in blocked state when the interrupt control means is closed, opening of the interrupt control means effecting, first, conduction of the first timing circuit transistor (19) and then, after said timing interval, as determined at least in part by said capacitor (24), the second timing circuit transistor (20) will become conductive, to ensure reliable turn-off of the thyristor (13) connected in shunt with the primary (6) of said coil (7).

13. System according to claim 1, further comprising a timing circuit (19, 24, 20) connected to said auxiliary switch (13) and said main switch (8) and controlling said main (8) to be conductive for the duration of the timing interval of said timing circuit, and then open, while simultaneously controlling the auxiliary switch (13) to also open to abruptly interrupt current flow through the primary (6) of the ignition coil (7) and thus induce a high-voltage spark pulse in the secondary (10) of the ignition coil, connection of the main switch (8) during said timing interval ensuring turn-off and opening of the auxiliary switch (13) prior to interruption of current flow through the primary (6) of the coil (7) and preventing inductive current flow through said shunt circuit.

* * * * *